United States Patent [19]

Fishler

[11] Patent Number: 4,791,978

[45] Date of Patent: Dec. 20, 1988

[54] GAS PERMEABLE STOPPER ROD

[75] Inventor: Mark K. Fishler, Tervuren, Belgium

[73] Assignee: Vesuvius Crucible Company, Pittsburgh, Pa.

[21] Appl. No.: 125,636

[22] Filed: Nov. 25, 1987

[51] Int. Cl.[4] ..... B72D 11/10

[52] U.S. Cl. ..... 164/437; 164/415; 222/602; 266/272; 266/220

[58] Field of Search ..... 164/415, 437, 337; 222/594, 597, 598, 602, 603; 266/271, 272, 236, 220

[56] References Cited

U.S. PATENT DOCUMENTS

| | | | |
|---|---|---|---|
| 1,085,181 | 1/1914 | Teeter | 222/597 |
| 3,033,550 | 5/1962 | Harders | 266/220 |
| 3,625,721 | 12/1971 | Snyder et al. | 106/65 |
| 4,064,925 | 12/1977 | Fastner et al. | 164/337 |
| 4,588,112 | 5/1986 | Kondo | 222/603 |
| 4,691,901 | 9/1987 | Dobner | 164/415 |

FOREIGN PATENT DOCUMENTS

| | | | |
|---|---|---|---|
| 3545763 | 6/1987 | Fed. Rep. of Germany . | |
| 54-5828 | 1/1979 | Japan | 222/594 |
| 58-120569 | 7/1983 | Japan | 222/594 |
| 59-195578 | 11/1984 | Japan | 164/437 |
| 60-96572 | 5/1985 | Japan | 164/337 |
| 60-131859 | 7/1985 | Japan | 164/437 |
| 2095612 | 10/1982 | United Kingdom . | |
| 2111880 | 7/1983 | United Kingdom . | |
| 2157210 | 10/1983 | United Kingdom . | |
| 2123726 | 2/1984 | United Kingdom . | |

*Primary Examiner*—Kuang Y. Lin

*Attorney, Agent, or Firm*—Webb, Burden, Ziesenheim & Webb

[57] ABSTRACT

A one-piece carbon-bonded graphite refractory stopper rod for use in continuous casting of molten metal includes a copressed body portion with an integral porous nose section. Through a gap grain sizing technique, the mean pore size of the nose is controlled to preferably about 10 microns to permit an inert gas introduced into the rod to permeate therethrough as a fine dispersion of bubbles in the melt while preventing reverse permeation of molten metal in the event of depressurization of the gas supply. Improved erosion resistance of the nose and lower alumina deposition in the casting nozzle are also achieved.

24 Claims, 1 Drawing Sheet

GAS PERMEABLE STOPPER ROD

BACKGROUND OF THE INVENTION

The present invention relates generally to stopper rods for controlling the flow of molten ferrous metals and more particularly, to one-piece stopper rods which incorporate means for introducing an inert gas, such as argon, to the melt during casting operations.

In the art of continuous casting, it is well known to use one-piece refractory stopper rods for the control of molten metal flowing from a tundish to a water cooled mold. The stopper rod is moved up and down by the use of a rigging on the outside of the tundish to control the molten metal flow. While the principal is quite simple the working environment is very harsh. A refractory stopper rod must be able to withstand hours submerged in molten steel. It must also be capable of enduring the harsh thermal shock encountered on the start-up of casting.

In recent years, the one-piece stopper rod has been used to introduce an inert gas, usually argon gas, into the molten metal. The argon gas serves several purposes in the continuous casting process. First, the non-metallic inclusions in the molten metal are floated out as the gas bubbles upwardly through the metal in the tundish. The rounded portion at the nose of the stopper rod is in contact with a submerged entry nozzle which protects the stream as it exists the tundish and flows into the continuous casting mold. A problem frequently encountered in the continuous casting of steel is clogging of this submerged entry nozzle due to aluminum oxide present in the molten steel. Argon injection through the stopper rod above the nozzle also minimizes this problem.

It is often very difficult to obtain a gas tight seal at the top of the stopper rod where it connects to the rigging on the tundish. The gas tight seal is important due to the fact that the flow of the steel from the tundish to the casting mold creates a vacuum. This vacuum can draw air through the stopper rod and into contact with the molten metal, causing oxidation and a subsequent reduction in the quality of the metal being cast. Injection of argon through the bore of the stopper rod eliminates this potential problem by creating a positive pressure inside the stopper.

In present day steel making, the injection of argon through a one-piece stopper rod has become the industry standard for the continuous casting of steel. In order to meet the industry requirements, a number of stopper rod designs are presently utilized to inject argon into a tundish and continuous casting nozzle. While these designs generally meet the requirements of steel makers, they often have significant limitations. An earlier attempt to introduce inert gas to a stopper rod consists of a one-piece stopper rod with a hole either pressed or drilled through the end of the rod. This solution has several major problems. First, if for any reason, the argon flow is interrupted, the rod bore fills up with steel due to the ferrostatic pressure in the tundish, making it necessary to terminate the cast. The stopper rod hole, which is generally about 2 to 3 mm in diameter, also produces very large argon bubbles. Large bubbles are not as effective as small bubbles in cleaning the steel by raising inclusions. In addition, with a hole completely through the rod, it is difficult to maintain gas pressure within the rod, thus making gas flow control difficult.

In order to overcome the above problems, a further design has evolved. In this prior approach, a prefabricated porous refractory plug is cemented into a bore pressed through the nose of the stopper rod. The plug is generally a high alumina ceramic bonded composition with the permeability controlled by a technique known as gap-grain sizing. This technique controls the pore size by controlling the grain sizing of the raw materials used to fabircate a ceramic body. This approach overcomes several of the problems existing in the above described simple hole type design. First, the porous plug gives very fine bubble dispersion, and, as such, is effective in cleaning the steel. The porous plug also allows the creation of back pressure in the rod bore so that gas flow can be more easily controlled. The problems encountered with this type of design concern the loss of the porous plug during the casting whenever the cement joint fails. If too high a gas pressure is exerted on the plug, it can be blown completely out of the rod. The loss of the porous plug is catastrophic, again causing the rod bore to fill up with steel and halting the casting run.

A still further design of the stopper rod heretofore proposed comprises a composite of the aforementioned porous plug and the small diameter nose hole types. In this prior approach, a preformed porous plug is co-pressed into the bore of the stopper rod upstream of a smaller diameter nose hole during the manufacturing process. This design offers an improved degree of safety due to the fact that the porous plug cannot be lost in use. The porous plug also guarantees the maintenance of a positive pressure upstream in the stopper rod bore. The disadvantage of this type of design is that the desired effect of the fine bubbles of inert gas is lost due to the presence of the hole between the porous plug and the stopper nose. In addition, this design is quite difficult to manufacture. Pressing the plug in the stopper rod at the high pressure used in the manufacturing of the stopper rod often destroys the integrity of the porous plug. This makes it difficult to manufacture a reproducible product. Any material that accidentally comes between the plug and the channel during the assembly of the tooling prior to the isostatic pressing of the rod will block the plug, consequently blocking the flow of gas. No solution has been found that completely meets the requirements of steel makers by solving the difficulties previously mentioned.

The present invention solves the problems heretofore encountered in the prior art by providing a one-piece stopper rod with an integral porous nose which delivers a fine dispersion of inert gas bubbles to the molten metal with no danger of porous plug blowout. The invention also prevents the backflow of molten metal into the bore of the stopper rod in the event inert gas flow is interrupted. The invention further provides a one-piece refractory stopper rod possessing high resistance to thermal shock and steel erosion while retaining the benefits of a gas permeable nose portion. The invention still further provides a one-piece stopper rod with a porous nose which permits maintenance of sufficient gas pressure within the rod to achieve uniform gas flow therethrough.

SUMMARY OF THE INVENTION

Briefly stated, these above-mentioned benefits, as well as others, are achieved by the present invention which is in the form of a one-piece refractory stopper rod having an integral, porous nose section. The stopper rod comprises an elongated cylindrical body having an axial bore therethrough and an opening at an upper, first end. The upper end of the bore preferably has a threaded portion adapted to be attached by a suitably threaded fitting and conduit to a pressurized source of inert gas, such as argon gas. A lower, or second end of the stopper rod body carries an integral porous nose section having an inner surface which faces the lower end of the open bore and and an outer surface in contact with the molten metal which is adapted to permit the inert gas to travel therethrough and bubble into the molten metal which surrounds the stopper rod when in use. The stopper rod body and nose section are isostatically co-pressed of similar materials, preferably, of a carbon-bonded graphite refractory grain composition but of differing grain sizing so as to yield a fired piece having substantially different mean pore sizes and gas permeabilities in the body and the nose section. The nose section preferably has a mean pore size on the order of about 10 microns, which is about forty times greater than the mean size pore within the body portion. The nose section has controlled permeability to allow the inert gas to be injected into the molten metal while the integral body of the stopper rod is sufficiently dense to prevent gas from permeating the body during pressurization.

In one presently preferred form of the invention, the stopper rod comprises a body portion and an integral, co-pressed nose section, both of a carbon-bonded alumina graphite composition having a mean pore size in the nose section of about 10 microns and that of the body of about 0.25 microns. The above composition also preferably contains a secondary grain of zirconia mullite material, comprising constituents of $ZrO_2$, $Al_2O_3$ and $SiO_2$, in an amount of about 10% to about 15%, by weight. A conventional antioxidant is also preferably added to the mixes in the form of boron containing or silicon containing compounds. The particle size distribution of the refractory grain, such as $Al_2O_3$ in the porous nose section is controlled within a narrow range and preferably within the range of about 100 to 200 screen mesh or about 75 to about 150 microns. This grain gap sizing technique yields a substantially uniform mean pore size of about 10 microns in the fired piece. The graphite is natural vein or flake graphite having a typical size within the range of about 30 to 100 mesh or about 150 to about 600 microns.

The refractory composition of the porous nose section of the stopper rod can be tailored to fit the intended use environment. For severe steel casting conditions, porous nose compositions of dense carbon-bonded zirconia graphite, or dense carbon-bonded magnesia graphite may be used in place of the dense carbon-bonded alumina graphite nose composition described above. The stopper rod body composition preferably still retains the less expensive carbon-bonded alumina graphite composition.

The binders employed in the refractory-carbon mixes for the nose and body sections are preferably identical, such as a carbonaceous resin, pitch, or the like. Use of identical binder systems improves the bonding at the interface between the porous and non-porous sections of the stopper rod. In addition, the intereface zone between the porous nose and dense body may contain a 50—50 mixture of the body and the nose compositions to form a compositional gradient for stopper rods having different nose and body refractory compositions. Grain size distributions may also be varied to control pore size in this interface zone.

The physical configuration of the porous nose section is easily changed during the pressing step to achieve a wide variety of gas-flow patterns and flow rates in the fired piece.

DETAILED DESCRIPTION OF THE INVENTION

Figure 1:
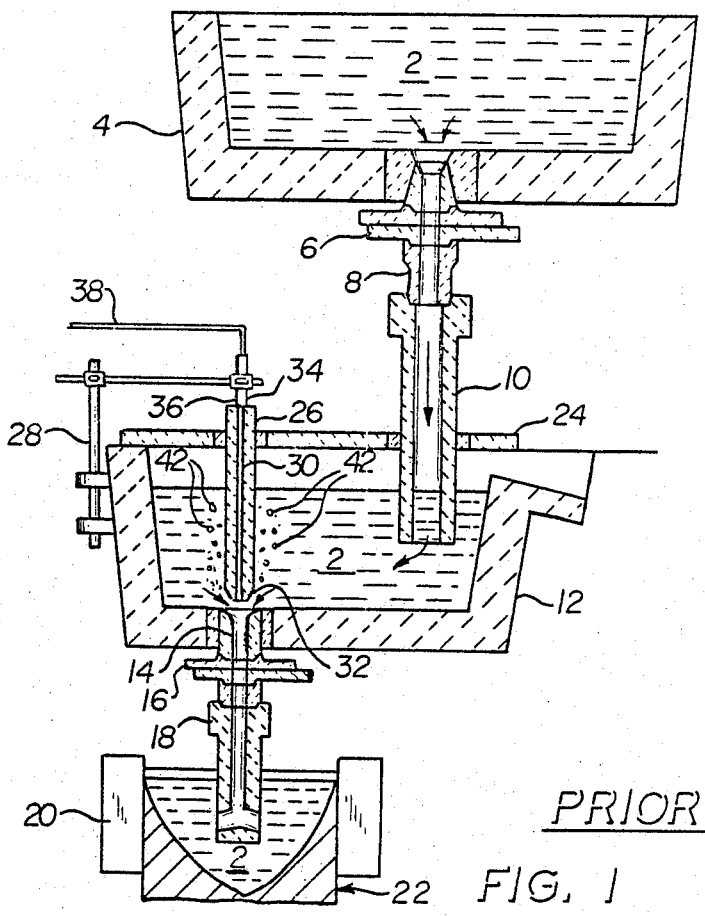
PRIOR ART FIG. 1
FIG. 1 is a simplified schematic drawing of a continuous casting arrangement showing a conventional one-piece stopper rod in use in a tundish.

Reference is now made to the drawings, and, specifically to FIG. 1, wherein a typical prior art continuous casting arrangement is schematically shown. Molten steel 2 contained within a ladle 4 is transferred through a conventional sliding nozzle 6, collector nozzle 8 and long nozzle 10 to a tundish 12 of known design, having a cover 24. Flow of metal 2 from the tundish is controlled by a stopper rod 26 which is raised and lowered by conventional rigging 28. The molten metal exits the bottom of the tundish through an outlet orifice at tundish well 14 and flows through conventional sliding nozzle 16 and thence to a submerged pouring nozzle 18 which delivers the metal to a chilled mold 20, all in a known manner.

The one-piece prior art stopper rod 26 of FIG. 1 has an axial bore 30 which extends from the top end 34 of the rod to the exterior of the nose portion 32 at the bottom end of the rod. A threaded tubular fitting 36 is secured within the bore 30 at the top of the stopper rod and is attached to a flexible conduit 38 which is, in-turn, connected to a pressurized source of inert gas, such as argon gas. Pressurized argon gas flows downwardly through the stopper rod bore 30 to exit at nose 32 whereupon argon bubbles 42 rise upwardly through the molten steel 2 in the tundish. As previously mentioned, this one type of known stopper rod, having the through bore at the nose, produces relatively large bubbles which are not as effective as small bubbles in removing inclusions from the melt. In addition, gas pressure is difficult to control in this type of stopper rod due to the open through bore 30 which also proves catastrophic in the event of gas flow depressurization or interruption.

Figure 3:
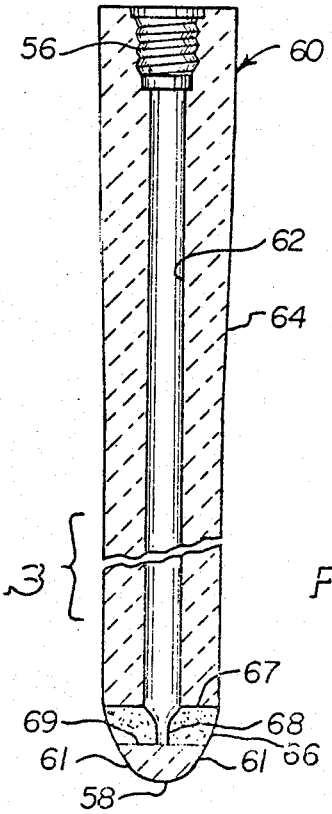
FIG. 3 is a stopper rod similar to that depicted in FIG. 2 but having a slightly modified form of porous nose section.
Figure 4:
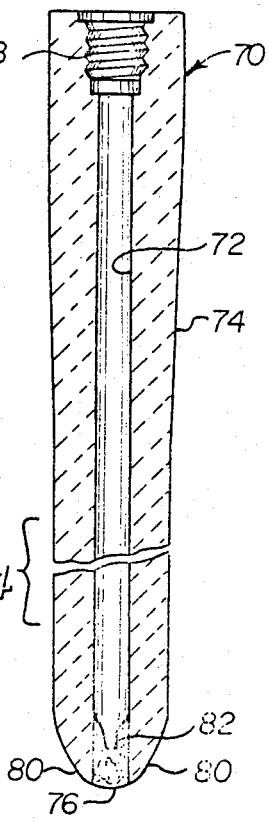
FIG. 4 is a stopper rod similar to those shown in FIGS. 2 and 3 but having a further modified form of porous nose section.

The one-piece stopper rod of the present invention overcomes these shortcomings of the prior art. Several presently preferred embodiments of a one-piece stopper rod in accordance with the invention are shown in FIGS. 2–4.

Figure 2:
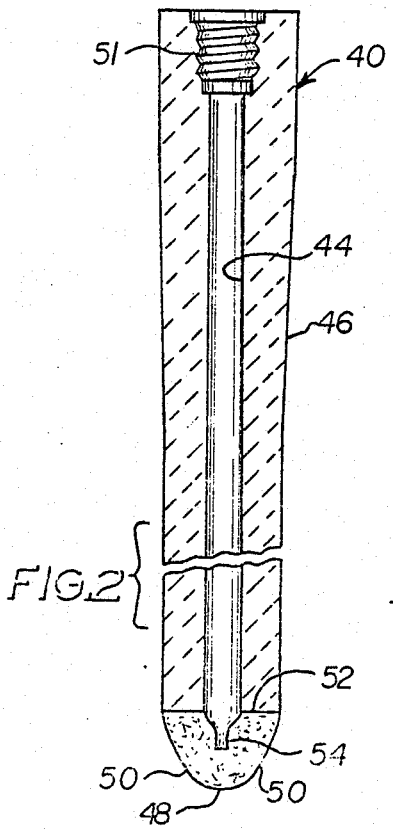
FIG. 2 is a side cross-sectional view of a stopper rod constructed in accordance with the present invention, having a porous nose section.

A one-piece stopper rod 40, depicted in FIG. 2, is generally cylindrical in shape comprising a body portion 46 and an integral, porous nose section 48. The rod 40 has an axial bore 44 having an open end at the top of the rod with a threaded portion 51 which is adapted to receive a threaded gas tight fitting therein for introduction of an inert gas, such as argon, to the bore. The axial bore 44 terminates at a closed lower end which is formed as an elongated or extended tip 54 to increase the internal surface area of the porous nose section 48 to insure uniform gas transmission to the porous nose. The nose 48 has a generally rounded contour at a seal area 50 where the rod makes contact with the tundish well, when the rod is in a closed position. As will be discussed in greater detail hereinafter, the seal area 50 of the nose section is also subject to the greatest erosion affects from the molten steel during casting due to its close proximity to the higher velocity flow currents adjacent the tundish well.

In the manufacture of stopper rod 40, the body portion 46 is isostatically co-pressed with the porous nose section 48 and then fired to produce a unified refractory body which avoids the blowout problems present in the prior art cemented porous plugs. The porous nose 48 of FIG. 2 forms the entire bottom tip of the stopper rod 40 and meets the less permeable body portion 46 at a horizontally extending, annular interface 52. The porous nose 48 is composed of a carbon-bonded graphite refractory grain composition, which for many steel casting applications, is preferably a carbon-bonded alumina graphite refractory. The nose 48 has a predetermined gas permeability which is achieved by controlling the mean port size of the fired body to about 5 to 20 microns and preferably to about 10 microns mean pore size. Such controlled pore size permits the inert gas to be injected into the molten metal in a uniform and fine bubble array so as to greatly enhance the inclusion removal action of the gas. In the event of gas depressurization within the rod bore 44, there is no backflow of molten metal into the bore since the mean pore size of the nose section 48 is not sufficiently large to permit the passage of molten metal therethrough.

The body portion 46 is also preferably of a similar carbon-bonded graphite refractory composition but has a very low permeability and mean pore size, on the order of forty times less than nose section 48, so that no inert gas permeates the body sidewall during pressurization. The difference in permeability between the stopper rod body 46 and nose section 48 is controlled by a known technique, referred to in the art as gap grain sizing. The raw materials in the porous mix are blended in such a way to leave voids between the grains after the pressing, drying and firing processes are completed. These voids create a continuous channel of small pores for the gas to permeate without being so large that molten metal can infiltrate back into the pores in he event that the gas flow is interrupted to the stopper rod. Typically, the mean pore size of the porous section 48 is on the order of 10 microns. If the pore size is smaller, then an excessive back pressure is required to obtain the correct gas flow. If the pore size is too large, then problems of metal infiltration and subsequent erosion of the nose section by the molten metal are encountered.

In modern continuous casting of steel, very often special compositions are used on stopper rod noses when especially aggressive grades of steel are being cast. This is due to the high chemical wear encountered in the nose area 50. The throttling function the nose plays in controlling the rate of flow of the molten metal from the tundish to the mold enhances the accelerated wear. Preferably, as stated above, the stopper rod body 46 is of a carbon-bonded alumina graphite composition. For casting under normal conditions, the porous stopper nose 48 is also a carbon-bonded alumina graphite material. Table 1 gives the typical composition and physical properties for the stopper rod body 46 and gas permeable nose section 48 under normal steel casting conditions according to the present invention.

TABLE I

| | Stopper Rod Body (% by weight) | Permeable Nose (% by weight) |
|---|---|---|
| $Al_2O_3$ | 53% | 61% |
| Carbon | 31% | 22% |
| $SiO_2$ | 13% | 6% |
| $ZrO_2$ | 1% | 6% |
| Others | 2% | 5% |
| MOR, psi | 1100 | 1100 |
| Mean Pore Size | 0.25 Microns | 10 Microns |
| ASG | 2.86 | 3.00 |
| Porosity, % | 18.0% | 19.0% |
| Permeability | 1 liter/min | 48 liter/min |

The graphite is natural vein or flake graphite having a typical particle size ranging between about 30 to 100 mesh or about 150 to about 500 microns. A conventional antioxidant material in the form of a boron containing or silicon containing material, for example, is also added to the refractory mix. The refractory mixture is preferably in the form of agglomerated grains prior to pressing. In order to enhance the erosion resistance and thermal shock resistance of the porous nose section, a secondary grain of zirconia mullite material is included in the above composition, preferably in an amount of about 10% to 15% by weight. The binder, preferably a carbonaceous binder such as resin, is the same in both refractory mixes to better join the body and nose sections at the interface 52. A band layer of material comprising a 50—50 mixture of materials from the nose and the body compositions can also be positioned at the interface 52 to further increase bonding strength at the interface, if desired.

In order to achieve the desired low pore size and consequential low gas permeability in the body portion of the stopper rod, the particle sizing is controlled in a known manner to achieve good packing. Generally, a mixture of coarse and medium size alumina particles, less than 30 mesh, are mixed with fine alumina particles, −325 mesh, in a ratio of about 2:1 (coarse:fine) to form the body portion. The finer particles fill the voids between the coarser particles to achieve a high packing density which then yields a corresponding low mean pore size in the fired body. In gap grain sizing of the porous nose section, the alumina particles are held within a relatively narrow range, for example between about 100 to 200 mesh (about 75–150 microns). Such a uniformly sized particle mixture lacks the required finer particles to fill the voids, thus, a high degree of controlled permeability is achieved. The above particle size range yields a presently preferred mean pore size of about 10 microns for the nose section compared with a mean pore size of 0.25 microns for the dense body portion, yielding a mean pore size ratio of about 40:1 between the nose and body sections. Also noted in Table I, the gas permeability rate ratio between the nose and body is also greater than 40 to 1, while the apparent specific gravity ("ASG") and the modulus of rupture ("MOR") are the same or about equal in the two stopper rod sections.

The physical configuration of the co-pressed porous nose section can be modified to suit a variety of casting requirements so as to achieve differing bubble patterns and porous surface exposures. As seen in FIG. 3, a stopper rod 60 has a slightly modified form of porous nose section 66 from that of FIG. 2. The remaining elements, namely axial bore 62, threaded section 56 and extended bore tip 68 are the same as previously described. The porous nose section 66 is formed in an annular ring shape at the end of the body section 64 with a further tip portion 58 formed of dense, low permeability refractory material which may be the same as the body 64. This configuration of porous nose 66 produces a lower gas flow rate than the nose 48 of FIG. 2, while the desired fine bubble size and uniform pattern is still achieved. The dense tip 58 carries a seal area 61 where the high erosion activity usually occurs and thus provides additional protection against such wear. Once again, good adhesion and bonding strength are observed at the interfaces 67 and 69 between the high and low permeability portions when the same binder systems are employed and/or if transition mixes of refractories are used at the respective interface zones.

A still further modified form of a porous nose section 76 according to the present invention is shown in FIG. 4. Body portion 74 of stopper rod 70, having an axial bore 72, threaded section 78 and extended bore tip 82 is co-pressed with the gap grain sized nose portion 76, as previously described. The porous nose 76 is formed at the lowermost end of the rod bore 72 and is substantially the same diameter as the bore. This embodiment yields a still lower flow rate of gas while also providing a greater surface area of low permeability, high erosion resistant material around the seal area 80.

For severe steel casting conditions, stopper rod body noses of dense carbon bonded zirconia graphite, or dense carbon bonded magnesia graphite may be used in place of dense carbon bonded alumina graphite. By substituting zirconia or magnesia for the alumina in the porous nose mixture, a permeable nose capable of withstanding the most arduous casting conditions is obtained. In such modified forms, the body portion of the stopper rod may be made from the same refractory composition as the porous nose section or it may be co-pressed from the less expensive alumina-graphite mixture previously described in Table I.

FIELD TESTING

Stopper rods with co-pressed porous noses were fabricated with the compositions outlined in Table I and shaped identically to that shown in FIG. 2. The rods were taken for testing in a six strand bloom caster, casting 230×340 mm blooms. Normally the bloom caster uses stopper rods for injecting argon of the above-described prior art internal porous plug type. One stopper rod was used on each strand of the bloom caster (six in total for each heat made). Five strands were equipped with the standard prior art stopper rod, and one strand with the stopper rod 40 of the present invention. The casting was started and the amount of argon adjusted to give a visible rolling action in the continuous casting mold. The line pressure was one bar. No bubbling was observed in the tundish around the five standard stopper rods. The co-pressed stopper rod 40 of the invention produced a bubbling action in the tundish during the entire casting sequence. During the cast there was no increase of casting speed encountered on the co-pressed porous nose strand. An increase of speed indicates nose erosion. Total casting time was 9 hours. Twelve ladles of 90 tons were cast, the steel temperature in the tundish was 1545° C. Upon completion of the cast, the stopper rods and submerged pouring nozzles were removed for examination. The co-pressed nose stopper rod 40 showed little if any signs of visible erosion on the porous rod nose 48. Slight erosion was visible on the standard stopper rods. The submerged nozzle 18 used in conjunction with the copressed nose stopper had much less aluminum oxide build-up compared to the nozzles used with the standard stopper rods. This indicates that the fine gas bubble dispersion of the rod 40 was also more effective in removing inclusions of $Al_2O_3$ from the melt that the prior art stopper rods tested.

While several specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A refractory stopper rod for use in casting molten metal comprising:

a co-pressed and fired body portion and an integral porous nose section of refractory grain compositions which are bonded together along an interface region by a carbon bond during firing, said nose section having an exterior surface adapted to be in contact with the molten metal and having a controlled pore size defined by voids between adjacent grains, said stopper rod having bore means adapted to introduce a pressurized gas to an interior surface of said nose section whereby, in use, the pressurized gas permeates the pores of said nose section and exits said pores to enter the molten metal as a fine dispersion of bubbles emitted from the exterior surface of said nose section.

2. The stopper rod of claim 1 wherein the body portion and porous nose section are of similar carbon-bonded graphite refractory grain compositions and wherein said compositions include an identical bonding system whereby a continuous bond is formed at an interface region between said body portion and said nose section.

3. The stopper rod of claim 2 wherein the refractory grain consists essentially of a carbon-bonded alumina graphite composition.

4. The stopper rod of claim 3 including a secondary addition of a refractory grain comprising a zirconia mullite material present in at least said nose section composition.

5. The stopper rod of claim 1 wherein the porous nose section has a controlled pore size which is of a sufficient dimension to permit the pressurized gas to permeate therethrough while also preventing the molten metal to permeate in a reverse direction through said nose section in an event of gas depressurization.

6. The stopper rod of claim 5 wherein the porous nose section has a mean pore diameter of about 10 microns.

7. The stopper rod of claim 5 wherein the porous nose section has a mean pore size on the order of about forty (40) times greater than that of the body portion.

8. The stopper rod of claim 6 wherein the pore size of the nose section is controlled by a gap grain sizing technique.

9. The stopper rod of claim 8 wherein the porous nose section is of a refractory composition comprising alumina and graphite and wherein the starting alumina particle size is controlled between about 75 to about 150 microns.

10. The stopper rod of claim 1 wherein the porous nose section is of a carbon-bonded graphite refractory composition selected from one of the group consisting of carbon-bonded alumina graphite, carbon-bonded zirconia graphite, and carbon-bonded magnesia graphite.

11. A refractory stopper rod for use in the continuous casting of molten metal comprising:

a co-pressed body portion and an integral porous nose section of a carbon-bonded graphite refractory grain composition, said body having an elongated cylindrical shape and an axial bore formed therein with an opening at a first, upper end adapted to be attached to a pressurized source of inert gas, said bore terminating at a second, lower end adjacent to an inner surface of said porous nose section, the refractory grains of said body portion and integral nose section being bonded together along an interface region between said body and nose section by a carbon bond during firing, the nose section having an outer surface adapted to be in contact with said molten metal and having a controlled pore size defined by voids between adjacent grains whereby, in use, pressurized gas permeates the pores of said nose section and exits said pores to enter the molten metal as a fine dispersion of gas bubbles emitted from the exterior surface of said nose section and wherein said pore size is sufficiently small to prevent molten metal from permeating said nose section in the event of gas depressurization within said bore.

12. The stopper rod of claim 11 wherein the nose section has a mean pore size of about 10 microns.

13. The stopper rod of claim 11 wherein the nose section has a mean pore size on the order of about forty (40) times greater than that of the body portion.

14. The stopper rod of claim 11 wherein the porous nose section is of a composition selected from one of the group consisting essentially of carbon-bonded alumina graphite, carbon-bonded zirconia graphite, and carbon-bonded magnesia graphite.

15. The stpper rod of claim 14 wherein the nose section has a mean pore size of between about 5 to 20 microns.

16. The stopper rod of claim 11 wherein the body portion and porous nose section comprise carbon-bonded alumina graphite refractory material and wherein the nose section has a mean pore size on the order of about 10 microns and the body portion has a mean pore size on the order of about 0.25 microns.

17. The stopper rod of claim 11 wherein at least the porous nose section comprises a carbon-bonded zirconia graphite refractory material.

18. The stopper rod of claim 17 wherein the body portion comprises a carbon-bonded alumina graphite refractory material.

19. The stopper rod of claim 11 wherein at least the porous nose section comprises a carbon-bonded magnesia graphite refractory material.

20. The stopper rod of claim 19 wherein the body portion comprises a carbon-bonded alumina-graphite material.

21. A refractory stopper rod for use in casting molten metal comprising:

a co-pressed body portion and an integral porous nose section having an exterior surface adapted to be in contact with the molten metal and having a controlled pore size, said stopper rod having bore means adapted to introduce a pressurized gas to an interior surface of said nose section whereby, in use, the pressurized gas permeates said nose section and enters the molten metal as a fine dispersion of bubbles emitted from the exterior surface of said nose section, wherein the porous nose section has a controlled pore size defined by a mean pore diameter of about 10 microns which is sufficient to permit the pressurized gas to permeate therethrough while also preventing the molten metal to permeate in a reverse direction through said nose section in an event of gas depressurization.

22. A refractory stopper rod for use in casting molten metal comprising:

a co-pressed body portion and an integral porous nose section having an exterior surface adapted to be in contact with the molten metal and having a controlled pore size in which the nose section has a mean pore size on the order of about forty (40) times greater than that of the body portion, said stopper rod having bore means adapted to introduce a pressurized gas to an interior surface of said nose section whereby, in use, the pressurized gas permeates said nose section and enters the molten metal as a fine dispersion of bubbles emitted from the exterior surface of said nose section.

23. A refractory stopper rod for use in the continuous casting of molten metal comprising:

a co-pressed body portion and an integral porous nose section of a carbon-bonded graphite refractory grain composition, said body having an elongated cylindrical shape and an axial bore formed therein with an opening at a first, upper end adapted to be attached to a pressurized source of inert gas, said bore terminating at a second, lower end adjacent to an inner surface of said porous nose section, the nose section having an outer surface adapted to be in contact with said molten metal and having a controlled mean pore size of about 10 microns, whereby, in use, pressurized gas permeates said nose section and is injected into the molten metal as a fine dispersion of gas bubbles emitted from the exterior surface of said nose section and wherein said pore size is sufficiently small to prevent molten metal from permeating said nose section in the event of gas depressurization within said bore.

24. A refractory stopper rod for use in the continuous casting of molten metal comprising:

A co-pressed body portion and an integral porous nose section of a carbon-bonded alumina graphite refractory material, said body having a mean pore size on the order of about 0.25 microns and an elongated cylindrical shape and an axial bore formed therein with an opening at a first, upper end adapted to be attached to a pressurized source of inert gas, said bore terminating at a second, lower end adjacent to an inner surface of said porous nose section, the nose section having an outer surface adapted to be in contact with said molten metal and having a controlled mean pore size of about 10 microns whereby, in use, pressurized gas permeates said nose section and is injected into the molten metal as a fine dispersion of gas bubbles emitted from the exterior surface of said nose section and wherein said pore size is sufficiently small to prevent molten metal from permeating said nose section in the event of gas depressurization within said bore.

* * * * *

UNITED STATES PATENT AND TRADEMARK OFFICE

CERTIFICATE OF CORRECTION

PATENT NO. : 4,791,978

DATED : December 20, 1988

INVENTOR(S) : Mark K. Fishler

It is certified that error appears in the above-identified patent and that said Letters Patent is hereby corrected as shown below:

Column 1 Line 15 "principal" should read --principle--.

Column 2 Line 9 "fabircate" should read --fabricate--.

Column 5 Line 25 "port" should read --pore--.

Column 5 Line 48 "he" should read --the--.

Column 8 Line 3 "copressed" should read --co-pressed--.

Claim 15 Column 9 Line 42 "stpper" should read --stopper--.

Signed and Sealed this

Eighth Day of August, 1989

*Attest:*

DONALD J. QUIGG

*Attesting Officer*

*Commissioner of Patents and Trademarks*